US012799617B1

(12) United States Patent
Segletes et al.

(10) Patent No.: US 12,799,617 B1
(45) Date of Patent: Nov. 17, 2026

(54) IGNITION RESISTANT COATING SYSTEM USING ELECTRODEPOSITION AND THERMAL PROCESSING

(71) Applicant: Blue Origin Manufacturing, LLC, Huntsville, AL (US)

(72) Inventors: David Segletes, Taft, TN (US); Jonathan Johnson, Huntsville, AL (US); John W. Appleby, Jupiter, FL (US); Noah Sargent, Seattle, WA (US); Ding Wen Chung, Renton, WA (US); Tomasz Chojnacki, Maple Valley, WA (US)

(73) Assignee: Blue Origin Manufacturing, LLC, Huntsville, AL (US)

( * ) Notice: Subject to any disclaimer, the term of this patent is extended or adjusted under 35 U.S.C. 154(b) by 0 days.

(21) Appl. No.: 19/373,057

(22) Filed: Oct. 29, 2025

(51) Int. Cl.
*B32B 9/00* (2006.01)
*C25D 5/14* (2006.01)
*C25D 5/50* (2006.01)

(52) U.S. Cl.
CPC *C25D 5/14* (2013.01); *C25D 5/50* (2013.01)

(58) Field of Classification Search
CPC ..... C25D 5/14; C25D 5/50
USPC ..... 428/408
See application file for complete search history.

(56) References Cited

U.S. PATENT DOCUMENTS 3,578,440 A 5/1971 Eiselstein et al.
3,875,027 A 4/1975 Gondek
4,300,959 A 11/1981 Hurwitz et al.
6,939,621 B2 9/2005 Hara et al.
8,981,233 B2 3/2015 Sakurai et al.
9,770,887 B2 9/2017 Gong et al.
2003/0224263 A1 12/2003 Matsuoka
2011/0036621 A1* 2/2011 Kobayashi ..... C23C 10/30 428/626
2012/0009464 A1 1/2012 Nakazawa et al.
(Continued)

FOREIGN PATENT DOCUMENTS

CN 105063685 8/2017
CN 105063699 10/2017
(Continued)

OTHER PUBLICATIONS

Nababan et al., "Kinetics of high temperature oxidation of end-of-life Ni/Cu/Ni coated NdFeB rare earth permanent magnets," Corrosion Science, 189, 109560; 12 pages (2021).
(Continued)

*Primary Examiner* — Daniel H Miller
(74) *Attorney, Agent, or Firm* — Knobbe, Martens, Olson & Bear, LLP

(57) ABSTRACT

In one aspect, a method of fabricating a coating on a material is provided. The method includes providing a substrate of the material including nickel or a nickel alloy and electrodepositing a multilayer onto the substrate. Electrodepositing the multilayer includes electrodepositing a first nickel layer onto the substrate, electrodepositing a copper layer onto the first nickel layer, and electrodepositing a second nickel layer onto the copper layer. The method also includes thermal treating the substrate electrodeposited with the multilayer to diffuse the layers of the multilayer together and to metallurgically bond the multilayer to the substrate. In another aspect, a coating on a material is provided.

12 Claims, 6 Drawing Sheets

(56) References Cited

U.S. PATENT DOCUMENTS

| | | | | |
|---|---|---|---|---|
| 2012/0088118 | A1 | 4/2012 | Lomasney | |
| 2012/0192417 | A1 | 8/2012 | Kang | |
| 2017/0234216 | A1* | 8/2017 | Durrett | C23C 18/1633 428/550 |

FOREIGN PATENT DOCUMENTS

| | | |
|---|---|---|
| CN | 112176374 | 1/2021 |
| CN | 112941514 | 6/2021 |
| CN | 116356386 | 6/2023 |
| DE | 2106226 | 2/1972 |
| DE | 2909744 | 9/1980 |
| DE | 3934112 | 11/1992 |
| GB | 722121 | 1/1955 |
| GB | 1132808 | 11/1968 |
| JP | H03-97883 | 4/1991 |
| JP | H11-61377 | 3/1999 |
| JP | 7022266 | 2/2022 |
| TW | 202110624 | 3/2021 |
| WO | WO 02/103086 | 12/2002 |
| WO | WO 2013/127405 | 9/2013 |
| WO | WO 2020/226292 | 11/2020 |

OTHER PUBLICATIONS

Xie et al., "Corrosion resistance of Ni—Cu—Ni coating under hydrostatic pressure: Experimental and Molecular dynamics investigations," ElectroChimica Acta 523, 145897; 12 pages (Feb. 2025).

Xu et al., "Influence of Pretreatment Processes on Adhesion of Ni/Cu/Ni Multilayer on Polyetherimide Resin Reinforced with Glass Fibers," Metals, 12, 1359; 16 pages (2022).

Arellano, Jazmin Abril, "Oxygen Compatibility for Aerospace Materials," University of Texas at El Paso, Aug. 1, 2022; 69 pages.

Carpenter, H.W., "Protective Coating System for a Regeneratively Cooled Thrust Chamber, Tasks I and II Final Report," NASA CR-72569, R-7775, Feb. 1969; 104 pages.

Rosales et al., "Guide for Oxygen Compatibility Assessments on Oxygen Components and Systems," NASA, TM-2007-213740, Mar. 2007; 26 pages.

Team Xometry, "Monel® K500: Uses, Composition, Properties," Xometry, Jul. 1, 2023; 9 pages.

Dakua, Chinmaya Prasad, "Diffusion Study of Electrodeposited Copper-Nickel Multilayer," Department of Metallurgical and Materials Engineering, National Institute of Technology, Rourkela, 2015; 62 pages.

High Temp Metals, "Alloy 400 Technical Data," 2015; 3 pages.

* cited by examiner

IGNITION RESISTANT COATING SYSTEM USING ELECTRODEPOSITION AND THERMAL PROCESSING

BACKGROUND

Field

The technology relates generally to coatings. In particular, the present disclosure relates to electrodeposited and thermally processed coatings on a material and methods of fabricating the same.

Description of the Related Art

High temperature and high pressure oxygen rich environments, such as modern liquid rocket engine cycles, can result in combustion of metals. Thus, components operating in high temperature pressurized oxygen rich environments must be evaluated for autoignition and particle impact ignition risks. Three important environmental factors that significantly increase both the probability of ignition of a material and the severity of the fire once ignition has occurred are: (1) increasing oxygen concentration, (2) increasing system pressure, and (3) increasing system temperature. Many of the common high strength metals used for rocket engine components are susceptible to oxygen fire risks in oxygen rich liquid rocket engines. On the other hand, materials that are compatible with such environments are typically low strength materials or are protected by other means.

As an example, Monel Alloy 400 is an alloy with about 63-72% nickel, 28-34% copper, and small amounts of iron, manganese, carbon, and silicon. Monel alloys are used in high temperature, high pressure, oxygen rich environments and do not exhibit flammability concerns, but their usage is limited due to their low mechanical properties. In addition, typical coating systems used in high temperature, high pressure, oxygen rich environments have limitations in their applications (for example, brittleness, thickness nonuniformity, inability to apply coating system due to lack of line of sight, etc.).

SUMMARY

The embodiments disclosed herein each have several aspects, no single one of which is solely responsible for the present disclosure's desirable attributes. Without limiting the scope of the present disclosure, its more prominent features will now be briefly discussed. After considering this discussion, and particularly after reading the section entitled "Detailed Description" one will understand how the features of the embodiments described herein provide advantages over existing coatings and methods of fabricating coatings for use in high temperature, high pressure, oxygen rich environments.

In various implementations, a method of fabricating a coating on a material is provided. The method can include providing a substrate of the material comprising nickel or a nickel alloy and electrodepositing a multilayer onto the substrate. Electrodepositing the multilayer can include electrodepositing a first nickel layer onto the substrate, electrodepositing a copper layer onto the first nickel layer, and electrodepositing a second nickel layer onto the copper layer. The method can also include thermal treating the substrate electrodeposited with the multilayer to diffuse the layers of the multilayer together and to metallurgically bond the multilayer to the substrate.

In certain methods, thermal treating can include solution treating and age hardening. In some instances, thermal treating can further include stabilizing between solution treating and age hardening.

As an example, solution treating can include heating at a temperature in the range of 800 to 1100° C. for a period of time in the range of 1 to 8 hours. As another example, age hardening can include heating at a temperature in the range of 600 to 760° C. for a period of time in the range of 8 to 20 hours. As yet another example, stabilizing can include heating based at least in part on the heat treatment of the substrate.

In some embodiments, thermal treating can further include cooling in argon gas at least at 1.5±0.5° C. per minute down to at least 535±0.5° C. In some embodiments, thermal treating further can include cooling in argon gas down to less than 120±5° C.

In some instances, the first and second nickel layers can include pure nickel and the copper layer can include pure copper. The first nickel layer can have a thickness in the range of 10 to 100 microns. The copper layer can have a thickness in the range of 5 to 50 microns. The second nickel layer can have a thickness in the range of 5 to 50 microns.

In some examples, the fabricated coating can include at least 60 mass % nickel and less than 40 mass % copper. In some methods, the fabricated coating can include a composition in the range of 10 mass % nickel-90 mass % copper to 90 mass % nickel-10 mass % copper.

In some methods, electrodepositing the multilayer can be performed without direct line of sight. In some methods, electrodepositing the multilayer further can include electrodepositing a second copper layer onto the second nickel layer and electrodepositing a third nickel layer onto the second copper layer. In some embodiments, the provided substrate can be gas washed.

In various embodiments, the coating exhibits no ignition when exposed to more than 69 MPa pressure at 20° C. in pure oxygen as measured according to ASTM G124 promoted combustion testing. In various methods, the coating can be metallurgically bonded to the substrate by diffusion. In some examples, the coating can have an adhesion strength of at least 17 MPa. In some instances, the adhesion strength can be at least 69 MPa.

In various implementations, a coating on a material is provided. The coating on a material can include a substrate of the material including nickel or a nickel alloy. The coating on a material can also include an interdiffused coating metallurgically bonded to the substrate. The coating can be formed of a first diffused nickel layer onto the substrate, a diffused copper layer onto the first nickel layer, and a second diffused nickel layer onto the copper layer. In various embodiments, the coating exhibits no ignition when exposed to more than 69 MPa pressure at 20° C. in pure oxygen as measured according to ASTM G124 promoted combustion testing.

In some embodiments, the coating can have a thickness in the range of 20 to 200 microns. In some examples, the coating can include at least 60 mass % nickel and less than 40 mass % copper. In some instances, the coating can include less than or equal to 2.5 mass % iron, manganese, carbon, and silicon. In some instances, the coating can include 0 mass % carbon. In some examples, the coating can include a composition in the range of 10 mass % nickel-90 mass % copper to 90 mass % nickel-10 mass % copper.

In various embodiments, the coating can be homogeneous. In various embodiments, the coating can be metallurgically bonded to the substate by diffusion. In some examples, the coating can have an adhesion strength in the range of at least 17 MPa. In some instances, the adhesion strength can be at least 69 MPa.

In some embodiments, the coated substrate can have a surface roughness in the range of 0.4 to 12.7 micrometer Ra. In some instances, the coated substrate can have a strength in the range of 300 to 1750 MPa.

BRIEF DESCRIPTION OF THE DRAWINGS

In the following detailed description, reference is made to the accompanying drawings, which form a part hereof. Understanding that these drawings depict only several embodiments in accordance with the present disclosure and are not to be considered limiting of its scope, the present disclosure will be described with additional specificity and detail through use of the accompanying drawings. In the drawings, similar symbols typically identify similar components, unless context dictates otherwise. In some drawings, various structures according to embodiments of the present disclosure are schematically shown. However, the drawings are not necessarily drawn to scale, and some features may be enlarged while some features may be omitted for the sake of clarity. The relative dimensions and proportions as shown are not intended to limit the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The disclosed technology is related to methods of fabricating a coating on a material and components having the coating. Monel and other nickel alloys are typically processed in casting or wrought (for example, forging, extrusion, rolling, drawing, etc.) product forms. The material system described herein can be fabricated using an additive electrodeposition or electroplating layering process that is subsequently heat treated to drive interdiffusion of nickel and copper layers (for example, discrete nickel and copper layers) to form a "Monel like" chemistry surface layer. For example, methods of fabricating a coating on a material according to embodiments of the present disclosure can fabricate a Monel like alloy that is metallurgically bonded to a relatively high strength substrate. As another example, coatings on a material can include a Monel like alloy metallurgically bonded to a relatively high strength component. Compared with Monel alloys, various embodiments of coatings fabricated using various embodiments of methods described herein can also be used in high temperature, high pressure, oxygen rich environments. In contrast to Monel alloys, various embodiments of coatings fabricated using various embodiments of methods described herein can also have advantageous mechanical properties (for example, high adhesion strength) for aerospace applications. In addition, various embodiments of coatings fabricated using various embodiments of methods described herein can have improved properties over other coating systems (for example, improved ductility, improved thickness uniformity, and can be applied without line of sight).

Figure 1:
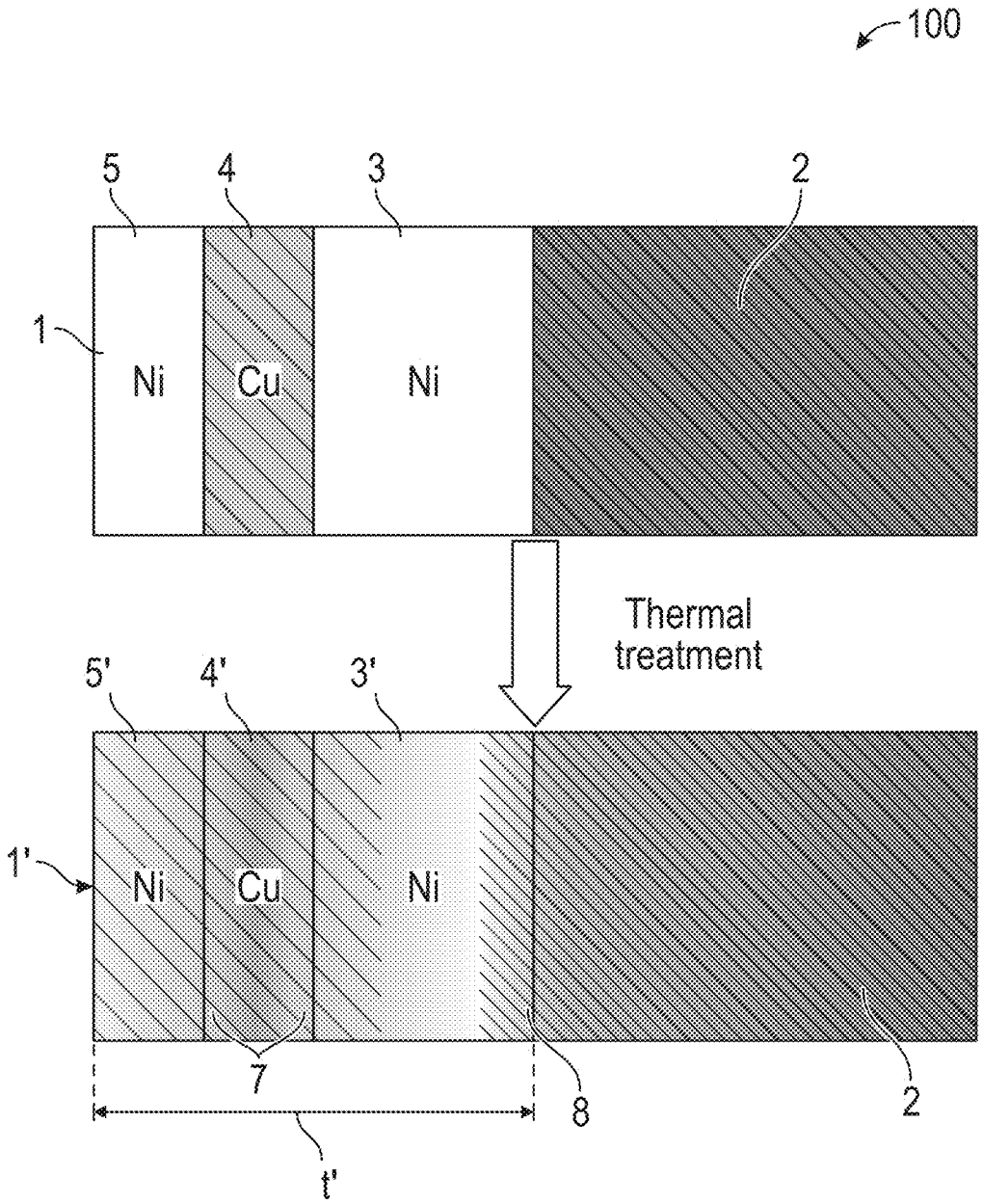
FIG. 1 is a schematic illustration of an example method of fabricating a coating on a material according to an embodiment of the present disclosure.

FIG. 1 is a schematic illustration of an example method 100 of fabricating coating 1' on a material (for example, a substrate 2) according to an embodiment of the present disclosure. As illustrated in FIG. 1, the method 100 can include electrodepositing (or electroplating) a multilayer 1 of alternating nickel (Ni), copper (Cu), nickel (Ni) layers 3, 4, 5 onto a substrate 2. The method 100 can further include a thermal treatment to diffuse the layers 3, 4, 5 into the coating 1' having diffused Ni and Cu layers 3', 4', 5' (with diffusion bonds 7 between the layers 3', 4', 5') that is metallurgically bonded to the substrate 2 (with diffusion bonds 8 between the multilayer composite coating 1' and the substrate 2). In various embodiments, the diffused Ni and Cu layers 3', 4', 5' can be a Monel like alloy coating formed from the thermally-processed alternating Ni and Cu layers 3, 4, 5 and metallurgically bonded to a high strength substrate 2. As described herein, such Monel like alloy coatings on high strength substrates can provide ignition resistant coatings for high temperature, high pressure, oxygen rich environments. For example, embodiments of coatings according to the present disclosure can be resistant to particle impact ignition. In some examples, embodiments of coatings according to the present disclosure can be burn resistant. The method 100 illustrated in FIG. 1 will be described in further detail with reference to FIG. 2, FIG. 2A, and FIG. 2B.

Figure 2A:
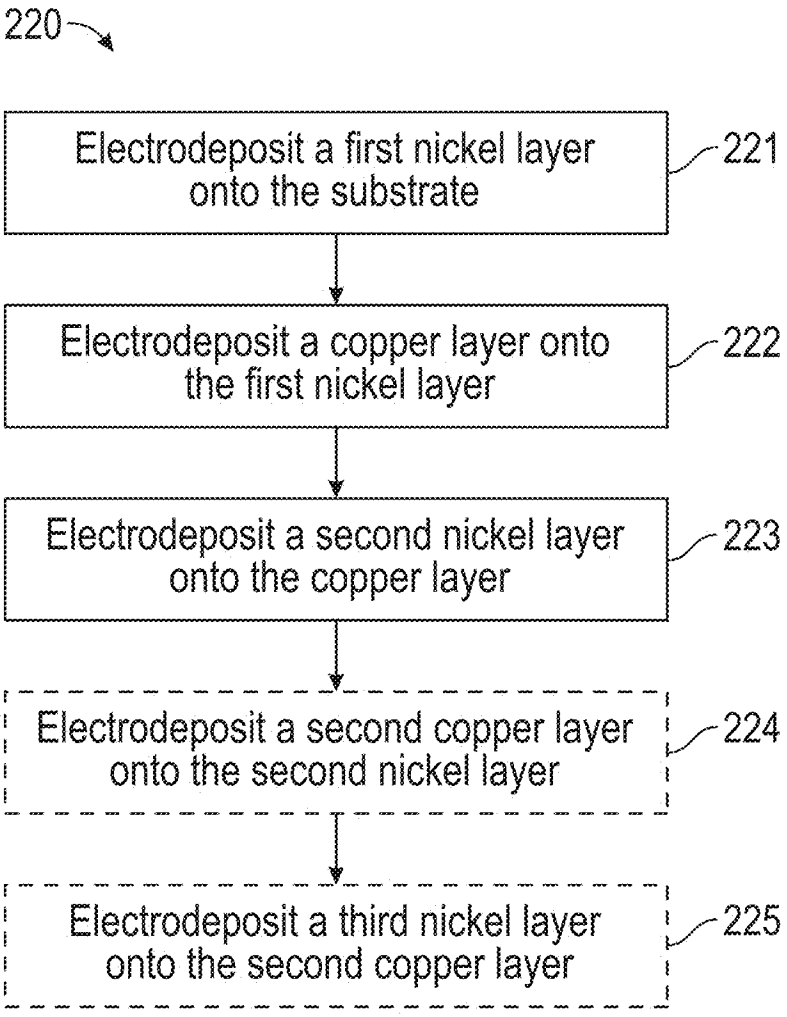
FIG. 2A is a flow chart representing an example method of electrodepositing a multilayer onto a substrate as referenced in FIG. 2.
Figure 2:
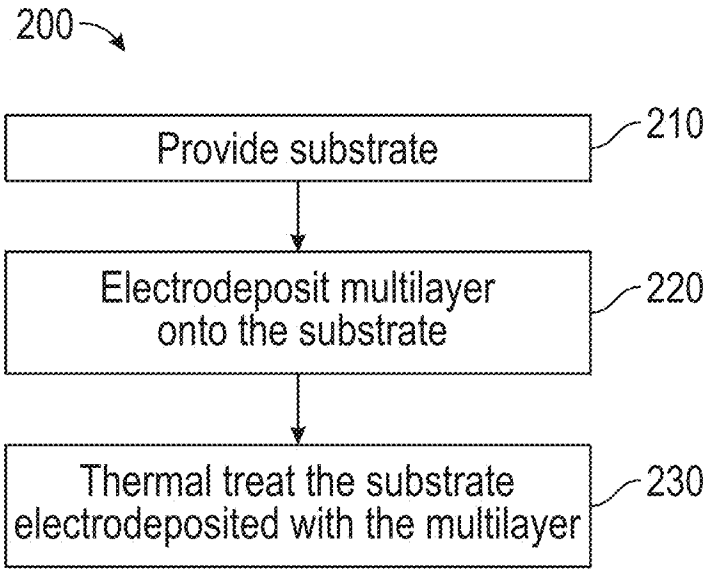
FIG. 2 is a flow chart representing the example method of fabricating a coating on a material as schematically illustrated in FIG. 1.

FIG. 2 is a flow chart representing the example method 100 of fabricating a coating 1' on a material as schematically illustrated in FIG. 1. The method 200 can begin at block 210 by providing a substrate of the material. With reference to FIG. 1, the provided substrate 2 can refer to the component (for example, a component of a rocket (such as rocket engine turbo machinery) or other component to be used in high temperature, high pressure, oxygen rich environments) to be coated. The substrate 2 can include a high strength substrate such as Ni or a Ni alloy. The advantages of using a high strength substrate are numerous in rocket engine design and may include decreased mass and increased fracture toughness. In some embodiments, the substrate 2 can include commercially pure Ni (for example, as defined by standard UNS N02200 with properties defined by ASTM B160 specification including a yield strength of about 427 MPa and ultimate tensile strength of about 600 MPa). In some embodiments, the substrate 2 can include pure elemental materials (for example, Nickel 200 or copper), copper based alloys (for example, Monel 400 or Monel K-500), or coated nickel based superalloys (for example, IN718 as defined by UNS N07718 with properties defined by AMS5663 specification including a yield strength of about 1034 MPa and ultimate tensile strength of about 1241 MPa or IN625). Mechanical strength, fatigue resistance, corrosion resistance, melting temperature, and strength at operating temperature are some properties to consider when selecting the material for the substrate. In various implementations, the provided substrate 2 can be gas washed to clean and/or reduce (or remove) contaminants prior to electrodeposition.

With continued reference to FIG. 2, at block 220, the method 200 can also include electrodepositing a multilayer onto the substrate. FIG. 2A is a flow chart representing an example method of electrodepositing a multilayer onto the substrate. As shown in FIG. 2A, electrodepositing the multilayer can include electrodepositing a first nickel layer onto the substrate (block 221), electrodepositing a copper layer onto the first nickel layer (block 222), and electrodepositing a second nickel layer onto the copper layer (block 223).

With reference to FIG. 1, the multilayer 1 of alternating Ni, Cu, and Ni layers 3, 4, 5 can be electrodeposited onto the substrate 2 to achieve a desired coating thickness. For example, a first Ni layer 3 having a thickness t3 can be electrodeposited onto a substrate 2 followed by a Cu layer 4 having a thickness t4 and further followed by a second Ni layer 5 having a thickness t5. In various embodiments, the first and second Ni layers 3, 5 can be commercially pure Ni (for example, at least 99.0% Ni and typically 99.6% Ni) and the Cu layer 4 can be commercially pure Cu (for example, at least 99.0% Cu). In some examples, the Ni layers 3, 5 can include nickel as defined by standard UNS N02200 with properties defined by ASTM B160 specification including a yield strength of about 427 MPa and ultimate tensile strength of about 600 MPa. In some examples, the Cu layer 4 can include copper as defined by C10100 and C10200 compositions (such as 99.99% and 99.95% copper, respectively). Due to the physics of the plating process, pure material anodes are used in many embodiments. In some instances, alloys containing 0.04 to 0.06% phosphorus can be used. In other embodiments, cobalt, platinum, gold, and silver can be electrodeposited onto the substrate 2.

In some embodiments, the first Ni layer 3 can have a thickness t3 in the range of 10 to 100 microns, such as 10, 15, 20, 25, 30, 35, 40, 45, 50, 55, 60, 65, 70, 75, 80, 85, 90, 95, 100 microns, or any other thickness within this range. In some embodiments, the thickness t3 of the first Ni layer 3 can be in any range within this range, for example, any range formed by any of the foregoing values, such as 15 to 90 microns, 20 to 90 microns, 25 to 90 microns, 10 to 85 microns, 15 to 85 microns, 20 to 85 microns, etc.

In some embodiments, the Cu layer 4 can have a thickness t4 in the range of 5 to 50 microns, such as 5, 7, 10, 12, 15, 17, 20, 22, 25, 27, 30, 32, 35, 37, 40, 42, 45, 47, 50 microns, or any other thickness within this range. In some embodiments, the thickness t4 of the Cu layer 4 can be in any range within this range, for example, any range formed by any of the foregoing values, such as 5 to 47 microns, 12 to 40 microns, 15 to 40 microns, 10 to 37 microns, 12 to 37 microns, 10 to 35 microns, 12 to 35 microns, etc.

In some embodiments, the second Ni layer 5 can have a thickness t5 in the range of 5 to 50 microns, such as 5, 7, 10, 12, 15, 17, 20, 22, 25, 27, 30, 32, 35, 37, 40, 42, 45, 47, 50 microns, or any other thickness within this range. In some embodiments, the thickness t5 of the second Ni layer 5 can be in any range within this range, for example, any range formed by any of the foregoing values, such as 5 to 47 microns, 7 to 40 microns, 10 to 40 microns, 5 to 37 microns, 7 to 37 microns, 10 to 37 microns, 5 to 35 microns, 7 to 35 microns, 10 to 35 microns, etc.

With reference to FIG. 2A, in some instances, electrodepositing the multilayer 1 can further include electrodepositing a second copper layer onto the second nickel layer (optional block 224), and electrodepositing a third nickel layer onto the second copper layer (optional block 225). Although not shown in FIG. 1, it is understood that the multilayer 1 can include further alternating layers of Cu and Ni, for example a Ni layer, a Cu layer, a Ni layer, a Cu layer, a Ni layer, etc.

With continued reference to FIG. 2, at block 230, the method 200 can include thermal treating the substrate that was electrodeposited with the multilayer. With reference to FIG. 1, the thermal treatment can diffuse the layers 3, 4, 5 of the multilayer 1 together and can metallurgically bond (for example, by diffusion) the multilayer 1 to the substrate 2, thereby fabricating the coating 1' on the material 2. The coating 1' that is formed after thermal treatment can include a plurality of diffused layers 3', 4', 5'. For example, Ni atoms from the Ni layers 3, 5 can diffuse into the Cu layer 4, forming a diffused Cu layer 4'. In addition, Cu atoms from the Cu layer 4 can diffuse into the Ni layers 3, 5, forming diffused Ni layers 3', 5'. As a result, the Ni and Cu layers 3, 4, 5 are diffused together with a first diffused Ni layer 3' onto the substrate 2, a diffused Cu layer 4' onto the first diffused Ni layer 3', and a second Ni layer 5' onto the Cu layer 4.' In addition, diffusion bonds 7 can be formed between the diffused Cu layer 4' and first diffused Ni layers 3' and between the diffused Cu layer 4' and the second diffused Ni layer 5'. In various embodiments, the resulting chemical composition can provide evidence of interdiffusion. For example, prior pure materials can be replaced by mixed chemical layers from interdiffusion. With further reference to FIG. 1, a diffusion bond 8 can also be formed between the coating 1' and the substrate 2. For example, Ni atoms from the substrate 2 can diffuse into the adjacent Ni layer 3 and the Ni atoms from Ni layer 3 can diffuse into the substrate 2, forming a diffusion bond 8 between the diffused layers 3', 4', 5' and the substrate 2. Compared to other coatings formed by other methods, being metallurgically bonded by diffusion with substrate 2 can improve the bond strength (for example, adhesion strength) to survive the harsh gaseous oxygen environment.

Figure 2B:
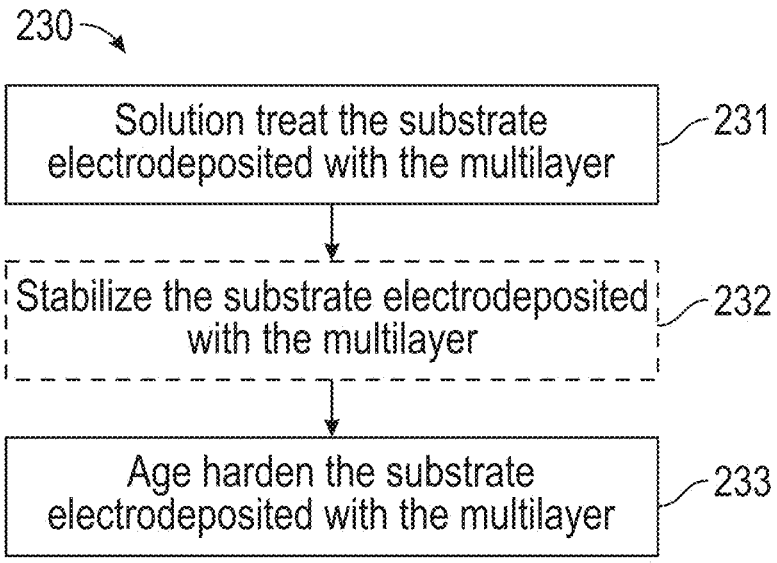
FIG. 2B is a flow chart representing an example method of thermal treating the substrate electrodeposited with the multilayer as referenced in FIG. 2.

FIG. 2B is a flow chart representing an example method of thermal treating the substrate that was electrodeposited with the multilayer. As shown in FIG. 2B, at block 231, thermal treating can include solution treating the substrate electrodeposited with the multilayer. In some instances, at block 232, thermal treating can include stabilizing the substrate electrodeposited with the multilayer. At block 233, thermal treating can include age hardening (or precipitation hardening) the substrate electrodeposited with the multilayer. Monel 400 is a non-age hardenable alloy. Typically, no thermal treatments are performed during fabrication (for example, cast, powder-printed, or wrought) other than for stress relief. In various embodiments described herein, a thermal solution treatment can be used to diffuse the electroplated layers with each other and into the substrate. A secondary age hardening thermal treatment can be performed to maintain, restore, and/or increase the strength of the Ni alloy substrate to the desired strength level. Advantageously, the solution thermal treatment is compatible with the age hardening thermal treatment, allowing creation of the desired diffused surface alloy chemistry and thickness without changing equipment or process steps for the strengthening heat treatment. Further, diffusion and bonding of the electrodeposited coating are consistent with heat treatment equipment currently used in the fabrication and production of other commonly used alloys, for example precipitation hardenable nickel based alloys.

An example thermal treatment of the substrate electrodeposited with the multilayer as shown in block 230 of FIG. 2 will now be described. In some embodiments, solution treating can include heating at a temperature in the range of 800 to 1100° C. for a period of time in the range of 1 to 8 hours followed by furnace quenching, and age hardening can include heating at a temperature in the range of 600 to 760° C. for a period of time in the range of 8 to 20 hours. In some instances, a stabilization heat treatment at temperatures based on substrate alloy heat treatment requirements can be performed without damage to the coating system. In some instances, thermal treating can include cooling in argon gas at least at 1.5±0.5° C. per minute down to at least 535±0.5° C. In some instances, thermal treating can further include cooling in argon gas down to less than 120±5° C.

Figure 3:
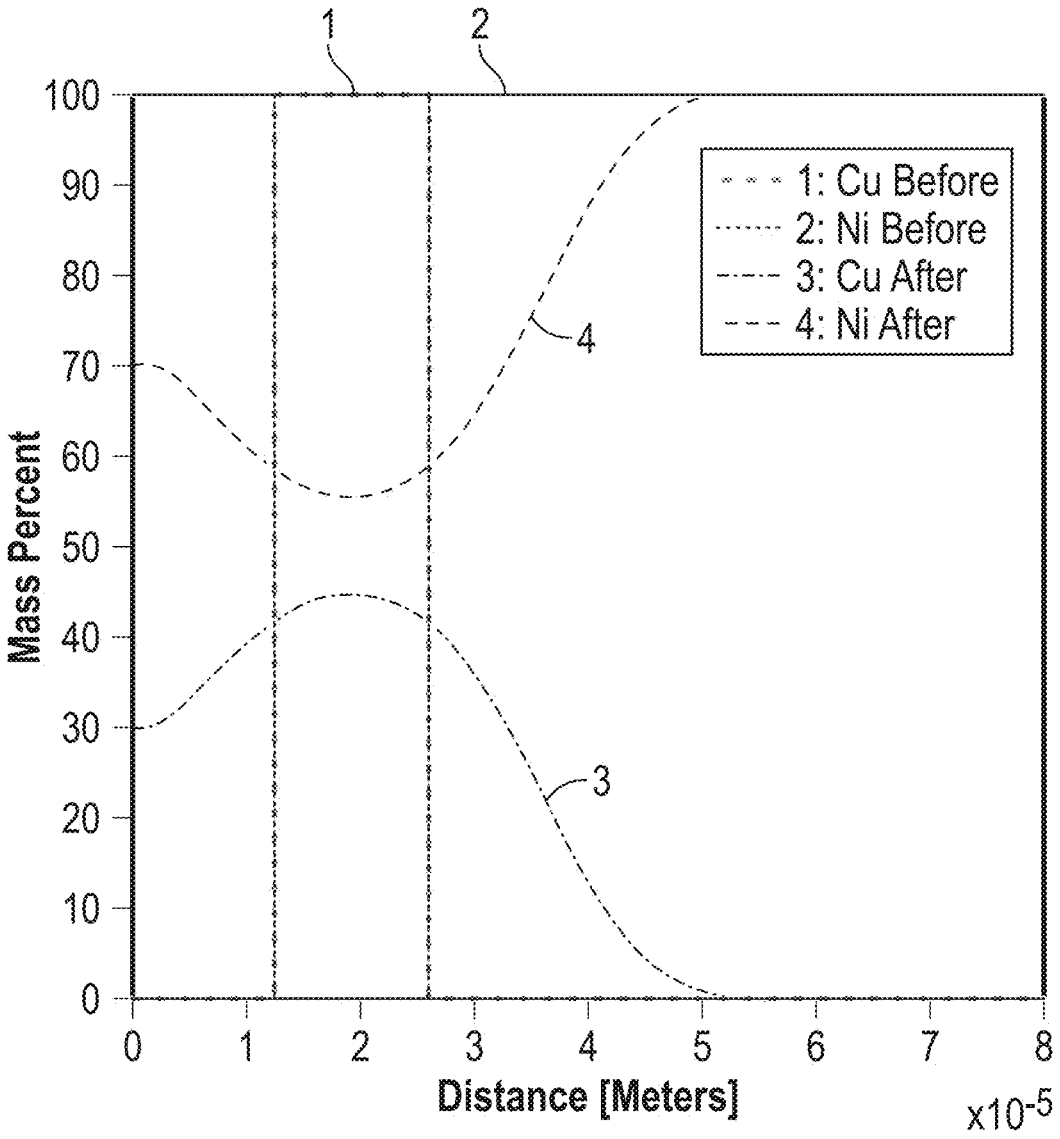
FIG. 3 is a diffusion couple model of an example coating according to an embodiment of the present disclosure.

FIG. 3 is a diffusion couple model of an example coating according to an embodiment of the present disclosure (for example, a coating formed by electrodepositing and thermal treating a first Ni layer 3, a Cu layer 4, and a second Ni layer 5 as described in FIG. 1). In this example, a first Ni layer has a thickness greater than 2 mils (or greater than $5\times10^{-5}$ meters), a Cu layer has a thickness of about 0.53 mil (or about $1.35\times10^{-5}$ meters), and a second Ni layer has a thickness of about 0.47 mil (or about $1.2\times10^{-5}$ meters). Lines 1 and 2 show the mass percent of the Cu and Ni respectively before thermal treatment as a function of distance from an outer surface of the electrodeposited structure. Thus, the mass percent of Cu and Ni in the second Ni layer is shown between 0 and about $1.35\times10^{-5}$ meters, the mass percent of Cu and Ni in the Cu layer is shown between about $1.35\times10^{-5}$ and about $2.55\times10^{-5}$ meters, and the mass percent of Cu and Ni in the first Ni layer is shown from about $2.55\times10^{-5}$ meters and greater. Line 1 shows 0% Cu in the first and second Ni layers and 100% Cu in the Cu layer. Line 2 shows 100% Ni in the first and second Ni layers and 0% Ni in the Cu layer.

Curves 3 and 4 show the mass percent of the Cu and Ni layers respectively after thermal treatment. Curve 3 shows that Cu diffuses from the Cu layer into the first and second Ni layers. In this example, the mass percent of Cu in the Cu layer reduces from 100% (from before thermal treatment) to between about 40-45%, with more Cu in the middle of the Cu layer and less Cu towards the first and second Ni layers. In this example, the mass percent of Cu in the second Ni layer increases from 0% (from before thermal treatment) to between about 30-40% and the mass percent of Cu in the first Ni layer increases from 0% to between greater than 0% to about 40%, with less Cu as the distance increases away from the Cu layer. Similarly, curve 4 shows that Ni diffuses from the first and second Ni layers into the Cu layer. In this example, the mass percent of Ni in the second Ni layer reduces from 100% to between about 60-70%, with more Ni near the surface of the Ni layer than towards the Cu layer. In this example, the mass percent of Ni in the first Ni layer reduces from 100% to about 60% with distance towards the Cu layer. In this example, the mass percent of Ni in the Cu layer is between about 55-60%. After thermal treatment, the Ni and Cu layers are diffused together forming stronger bonds between the layers (for example, diffusion bonds). As described herein, after thermal treatment, the diffused Ni and Cu layers can form a Monel like alloy. As an example, the diffused Ni and Cu layers can form an alloy with an overall mass content of 70% Ni and 30% Cu. As indicated herein, in the first Ni layer, the mass percent of Cu reduces as the distance increases away from the Cu layer. If the first Ni layer has a substantial thickness, there may be a section where neither Ni nor Cu diffusion occurs. For example, after thermal treatment in this example, as the distance increases away from the Cu layer in the first Ni layer, the mass percent of Cu reduces to 0% and the mass percent of Ni increases to 100%. In addition, after thermal treatment, the Ni and Cu layers can form stronger bonds with the substrate (for example, diffusion bonds).

Figure 4B:
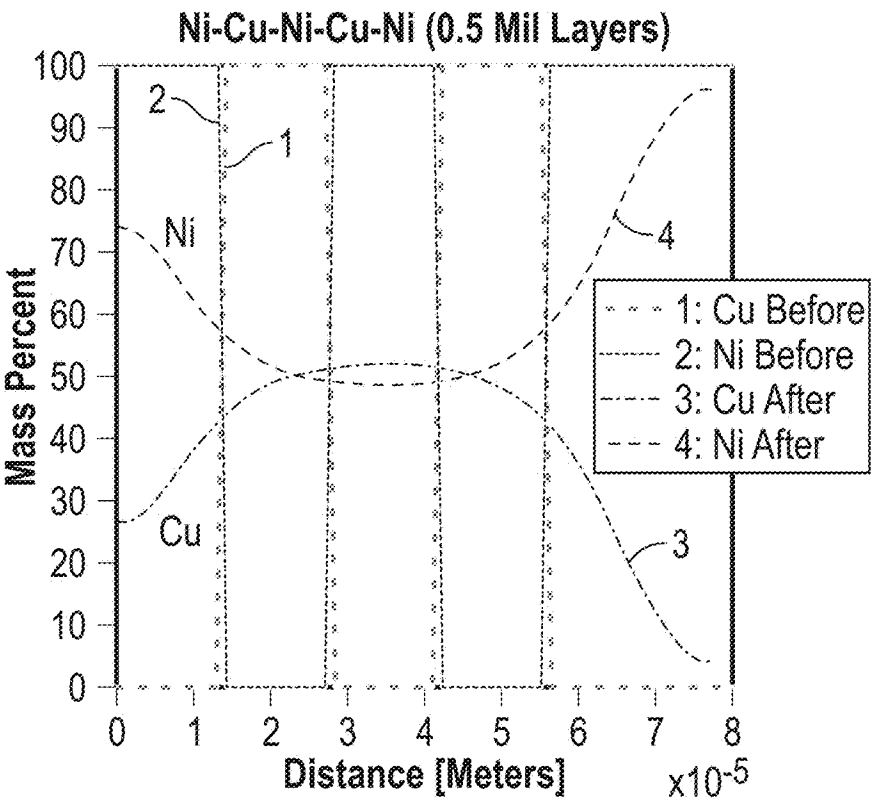
FIG. 4B is a diffusion couple model of another example coating according to an embodiment of the present disclosure.
Figure 4A:
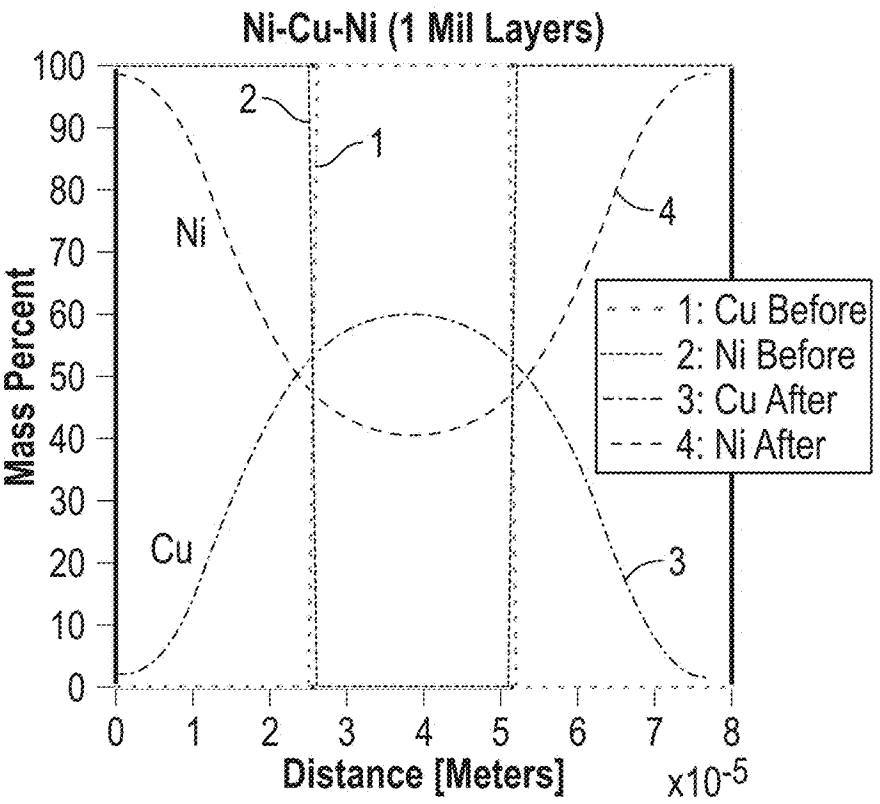
FIG. 4A is a diffusion couple model of another example coating according to an embodiment of the present disclosure.

Other examples are possible. For example, FIGS. 4A and 4B show diffusion couple models for other example embodiments of the present disclosure. In FIG. 4A, each of the Ni and Cu layers has a thickness of about 1 mil (or about 2.5×10−5 meters). In this example, after thermal treatment, the mass percent of Ni reduces from 100% to about 40% with distance towards the Cu layer (with the mass percent of Cu between 0 to 60%). In FIG. 4B, an additional Cu layer and an additional Ni layer are included. Each of the Ni and Cu layers has a thickness of about 0.5 mil (or about 1.3×10−5 meters). In this example, after thermal treatment, the mass percent of Ni and Cu is about 50%/50% in the middle Ni layer. In various embodiments, the ignition resistant coating chemistries can range from 10% Ni-90% Cu to 90% Ni-10% Cu.

With reference to FIG. 1, the diffused layers can provide the desired thickness t' for the coating 1'. In various implementations, the discrete layer thicknesses t3, t4, t5 of the electrodeposited layers 3, 4, 5 interdiffuse to form a homogeneous chemistry layer of a total thickness t' as the sum of the plated layers. In various designs, the coating 1' can have a thickness t' in the range of 20 to 200 microns, such as 20, 25, 30, 35, 40, 50, 60, 70, 80, 90, 100, 110, 120, 130, 140, 150, 160, 170, 180, 190, 195, 200 microns, or any other thickness within this range. In some embodiments, the thickness t' of the coating 1' can be in any range within this range, for example, any range formed by any of the foregoing values, such as 30 to 160 microns, 35 to 160 microns, 25 to 155 microns, 30 to 155 microns, etc.

As described herein, various implementations can form a Monel like alloy. For example, the formed coating 1' can include at least 60 mass % nickel and less than 40 mass % copper. For example, the Monel like alloy shown in FIG. 3 with a first Ni layer having a thickness greater than 2 mils (or greater than 5×10−5 meters), a Cu layer having a thickness of about 0.53 mil (or about $1.35\times10^{-5}$ meters), and a second Ni layer having a thickness of about 0.47 mil (or about $1.2\times10^{-5}$ meters) can have an overall mass content of 70% Ni and 30% Cu produced by interdiffusion of Ni and Cu multilayers. As another example, the formed coating 1' with each of a first Ni layer, a Cu layer, and a second Ni layer having a thickness of about 0.5 mil (or about $1.3\times10^{-5}$ meters) (for a total coating thickness of 1.5 mils (or about $3.9\times10^{-5}$ meters)) can include 61.4 to 61.7 mass % nickel and 38.3 to 38.6 mass % copper. The formed coating had a higher porous microstructure compared to coatings with a thicker first Ni layer, but was still ignition resistant (for example, having no ignition at pure oxygen pressure of 69 MPa at 20° C. as measured according to ASTM G124 promoted combustion testing). In some instances, the Monel like alloy can be similar to Monel 400 (UNS N04400). For example, the Monel like alloy can have at least 63 mass % nickel and 28 to 34 mass % copper. In one example, the Monel like alloy can have 66.5% Ni and 31-33.5% Cu produced by interdiffusion of Ni and Cu multilayers. Other examples are possible. In some instances, not necessarily like Monel, the formed coating 1' can include less than or equal to 2.5 mass % iron, manganese, carbon, and silicon. In some embodiments, the coating 1' can have 0 mass % carbon. By reducing iron, manganese, carbon, and silicon, various embodiments of a Monel like alloy described herein can have improved oxygen and/or ignition resistance compared to cast, powder-printed, or wrought (forged, extruded, rolled, drawn) Monel 400 which have such elements that lower oxygen and ignition resistance capability. In various instances, oxygen resistance can refer to the material's ability to resist negative effects of high levels of oxygen, which may include ignition. In various implementations, ignition resistance can refer to the material's ability to resist ignition, particle impact ignition, burning, and other damages from fire. As described herein, various embodiments can provide ignition resistant coatings for high temperature, high pressure, oxygen rich environments. For example, various embodiments exhibit no ignition when exposed to more than 69 MPa pressure in pure oxygen at 20° C. as measured according to ASTM G124 promoted combustion testing. Advantageously, embodiments of coatings according to the present disclosure can be resistant to particle impact ignition. In some examples, embodiments of coatings according to the present disclosure can be burn resistant.

Various embodiments of the formed coating 1' can also provide other improved properties for coatings used in high temperature, high pressure, and oxygen rich environments. For example, the fabricated coating can be ductile and less prone to cracking to reduce the negative impact on the fracture assessment for a given component due to exposure of the substrate to the combustible environment. In some examples, the coating 1' can have an adhesion strength of at least 17 MPa. In some examples, the coating 1' can have an adhesion strength of at least 69 MPa.

In various methods of forming the coating 1', the method can advantageously be applied onto the material with an improvement of uniform thickness. For example, in some examples, the coated substrate 2 can have a surface roughness in the range of 0.4 to 12.7 micrometer Roughness Average (Ra). In some examples, the coated substrate 2 can have a strength in the range of 300 to 1750 MPa. As described herein with reference to FIG. 2B, the secondary age hardening treatment can help maintain, restore, and/or increase the strength of the substrate 2.

Figure 5B:
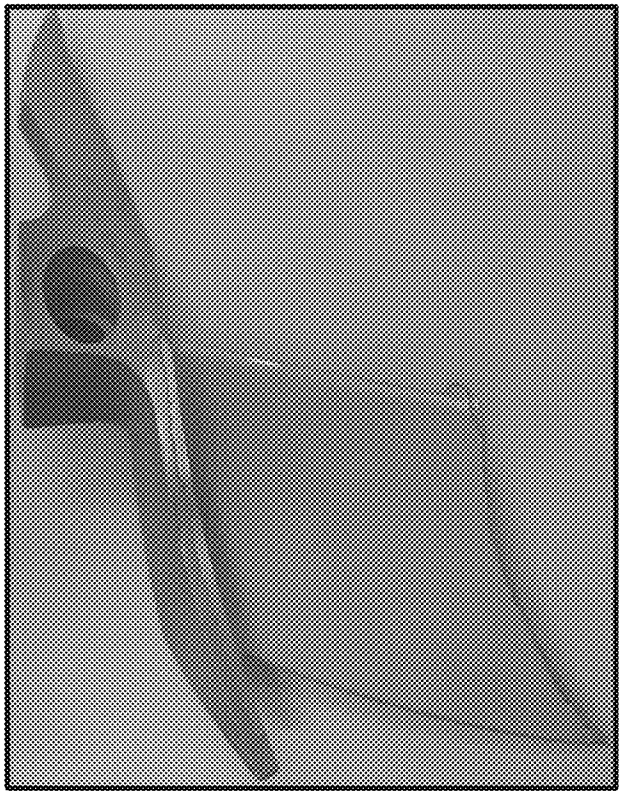
FIG. 5A and FIG. 5B are photographs of a component before and after being applied with a coating according to an embodiment of the present disclosure.
Figure 5A:
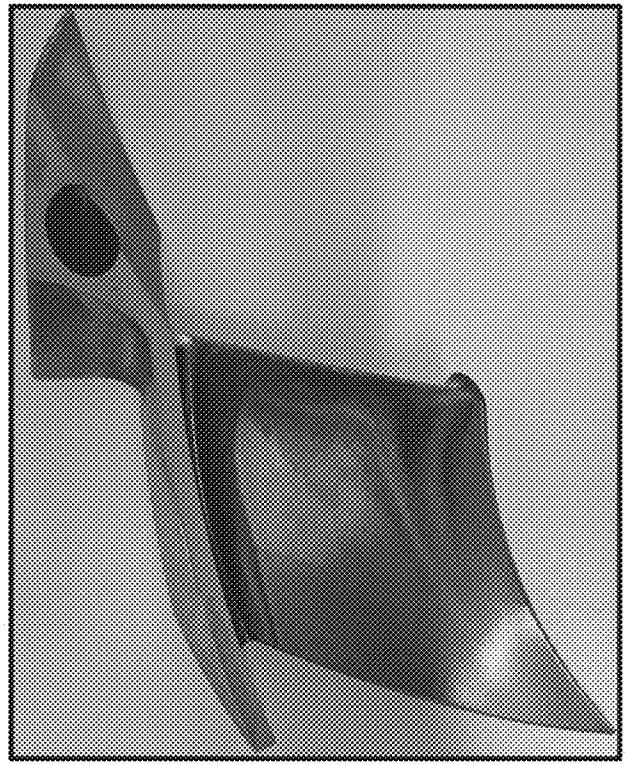

The above-described method can also be applied without direct light of sight and can reach inaccessible and/or difficult to reach surfaces. Advantageously, in various implementations, a component with a complex geometry, such as but not limited to rocket engine turbo machinery and airfoils, can be coated. For example, electrodeposition as described with reference to block 220 in method 200 of FIG. 2 and FIG. 2A can be advantageously applied onto a component without line of sight. FIG. 5A and FIG. 5B are photographs of an airfoil before and after being applied with a coating according to an embodiment of the present disclosure. In this example, post-plating heat treatment has not been performed on the coated airfoil illustrated in FIG. 5B. As shown, areas between fins which are difficult to access can be coated compared to other coating methods which may leave these areas with no coating, a poorly-formed coating, or a coating having an unacceptable thickness or uniformity. In sum, various embodiments of the methods described herein can provide various embodiments of coatings on a component without direct line of sight that are suitable for use in hot gaseous oxygen environments while maintaining the mechanical properties of the component.

In some examples of the present disclosure, the methods can include additional blocks during which further processing is performed. In addition, it will be understood that the methods need not be performed in the order described and/or some steps may be omitted.

While the above detailed description has shown, described, and pointed out novel features of the present disclosure as applied to various embodiments, it will be understood that various omissions, substitutions, and changes in the form and details of the process illustrated may be made by those skilled in the art without departing from the spirit of the present disclosure. As will be recognized, the present disclosure may be embodied within a form that does not provide all of the features and benefits set forth herein, as some features may be used or practiced separately from others. All changes which come within the meaning and range of equivalency of the claims are to be embraced within their scope.

The detailed description is directed to certain specific embodiments of the present disclosure. Reference in this specification to "one embodiment," "an embodiment," or "in some embodiments" means that a particular feature, structure, or characteristic described in connection with the embodiment is included in at least one embodiment of the present disclosure. The appearances of the phrases "one embodiment," "an embodiment," or "in some embodiments" in various places in the specification are not necessarily all referring to the same embodiment, nor are separate or alternative embodiments necessarily mutually exclusive of other embodiments. Moreover, various features are described which may be exhibited by some embodiments and not by others.

The terminology used in the description presented herein is not intended to be interpreted in any limited or restrictive manner, simply because it is being utilized in conjunction with a detailed description of certain specific embodiments of the development. Furthermore, embodiments of the present disclosure may include several novel features, no single one of which is solely responsible for its desirable attributes or which is essential to practicing the present disclosure.

The term "comprising" as used herein is synonymous with "including," "containing," or "characterized by," and is inclusive or open-ended and does not exclude additional, unrecited elements or method steps. With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity. In addition, it will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.).

Furthermore, in those instances where a convention analogous to "at least one of A, B, and C, etc." is used, in general such a construction is intended in the sense one having skill in the art would understand the convention (e.g., "a method having at least one of A, B, and C" would include but not be limited to methods that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawing, should be understood to contemplate the possibilities of including one of the terms, either of the terms, or both terms. For example, the phrase "A or B" will be understood to include the possibilities of "A" or "B" or "A and B."

All numbers expressing quantities, dimensions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not as an attempt to limit the application of the doctrine of equivalents to the scope of the claims, each numerical parameter should be construed in light of the number of significant digits and ordinary rounding approaches. For example, terms such as about, approximately, substantially, and the like may represent a percentage relative deviation, in various embodiments, of ±1%, ±5%, ±10%, or ±20%.

The above description discloses several methods and materials of the present disclosure. The present disclosure is susceptible to modifications in the methods and materials, as well as alterations in the fabrication methods and equipment. Such modifications will become apparent to those skilled in the art from a consideration of this disclosure. Consequently, it is not intended that the present disclosure be limited to the specific embodiments disclosed herein, but that it covers all modifications and alternatives coming within the true scope and spirit of the present disclosure.

What is claimed is:

1. A coating on a material comprising:

a substrate of the material comprising nickel or a nickel alloy; and an interdiffused coating metallurgically bonded to the substrate, the coating formed of:

a first diffused nickel layer onto the substrate, a diffused copper layer onto the first nickel layer, and a second diffused nickel layer onto the copper layer, wherein the coating exhibits no ignition when exposed to more than 69 MPa pressure at 20° C. in pure oxygen as measured according to ASTM G124 promoted combustion testing.

2. The coating on a material of claim 1, wherein the coating has a thickness in the range of 20 to 200 microns.

3. The coating on a material of claim 1, wherein the coating comprises at least 60 mass % nickel and less than 40 mass % copper.

4. The coating on a material of claim 3, wherein the coating comprises less than or equal to 2.5 mass % iron, manganese, carbon, and silicon.

5. The coating on a material of claim 4, wherein the coating comprises 0 mass % carbon.

6. The coating on a material of claim 1, wherein the coating comprises a composition in the range of 10 mass % nickel-90 mass % copper to 90 mass % nickel-10 mass % copper.

7. The coating on a material of claim 1, wherein the coating is homogeneous.

8. The coating on a material of claim 1, wherein the coating is metallurgically bonded to the substate by diffusion.

9. The coating on a material of claim 1, wherein the coating has an adhesion strength in the range of at least 17 MPa.

10. The coating on a material of claim 9, wherein the adhesion strength is at least 69 MPa.

11. The coating on a material of claim 1, wherein the coated substrate has a surface roughness in the range of 0.4 to 12.7 micrometer Ra.

12. The coating on a material of claim 1, wherein the coated substrate has a strength in the range of 300 to 1750 MPa.

* * * * *